United States Patent [19]

Looper et al.

[11] Patent Number: 4,669,368

[45] Date of Patent: Jun. 2, 1987

[54] COLLAPSIBLE PLUNGER

[75] Inventors: Larry L. Looper, South Lake; John C. Lory, Odessa, both of Tex.

[73] Assignee: Cooper Industries, Inc., Houston, Tex.

[21] Appl. No.: 515,208

[22] Filed: Jul. 19, 1983

[51] Int. Cl.[4] ..... F16J 1/00

[52] U.S. Cl. ..... 92/259

[58] Field of Search ..... 92/255, 258, 259, 257; 417/319; 403/2, 11, 41, 78; 74/492; 188/371, 376, 377

[56] References Cited

U.S. PATENT DOCUMENTS

| | | | |
|---|---|---|---|
| 1,731,147 | 10/1928 | Moyer et al. | 92/248 |
| 2,391,275 | 12/1945 | Shaw | 403/168 |
| 3,015,529 | 1/1962 | Hardcastle | 92/259 |
| 3,315,570 | 1/1965 | Brewer et al. | 91/401 |
| 3,899,047 | 8/1975 | Maeda et al. | 188/376 |
| 4,044,655 | 8/1977 | Kennicott | 92/258 |
| 4,411,546 | 10/1983 | Fischer | 403/2 |

*Primary Examiner*—Edward K. Look

*Attorney, Agent, or Firm*—Kanz, Scherback & Timmons

[57] ABSTRACT

A collapsible plunger (10) for use in a pump is disclosed having a load carrying cylinder (12) forming in inwardly facing tapered end (14), a plug (16) forming an outwardly facing taper (18) mating the inwardly facing tapered end of the cylinder, a stud bolt (20) engaging plug 16 on one end, a plunger clamp end (22) abutting the cylinder on the opposite end and a nut (24) engaging the other end of the stud bolt. The nut is free to move away from the plunger clamp end so that the stud bolt is never in compression. The tapered end of the cylinder will yield to the plug at a predetermined force. The abutment surfaces (30 and 32) of the cylinder and plunger clamp end permit some relative movement between the two.

11 Claims, 2 Drawing Figures

COLLAPSIBLE PLUNGER

DESCRIPTION

TECHNICAL FIELD

The present invention relates to pump plungers and, in one of its aspects, to plungers used in pumps for oil well fracturing.

A typical trailer mounted "frac" unit that is used by the oil well stimulation industry to "stimulate" or "fracture" an oil well in order to increase oil or gas production, includes a diesel engine, a multi-speed automatic transmission and a plunger pump mounted on a trailer frame. Necessary cooling is also mounted on the trailer along with a local and remote control system. During the pumping of the sand and gel mixture, a condition sometimes arises known as fluid end sand-out. A fluid end sand-out occurs when the sand and gel mixture gets packed between the end of the plunger and the suction cover. The sand and gel mixture loses the sand supporting gelled fluid. A solid wall of sand forms on the suction cover between the plunger and the suction cover. If this wall of sand becomes thicker than the clearance between the plunger at maximum displacement and the suction cover, an extremely high plunger loading occurs which will usually break something in the pump. Plungers routinely wear out and are considered to be expendable items.

BACKGROUND ART

U.S. Pat. No. 1,731,147 of Moyer et al and U.S. Pat. No. 3,015,529 of Hardcastle show built-up plungers constructed as a cylinder and heads on either end of the cylinder in Moyer and, similarily, a replaceable wear sleeve combined with a combination header and stud in Hardcastle. Moyer shows a unit held together by tension but which can also be in compression. Hardcastle shows the use of a tapered header. In neither case is the outer sleeve or cylinder intended as a significant load bearing member. U.S. Pat. No. 3,315,570 of Brewer et al shows one apparatus for relieving pressure at certain end positions of a power steering system in order to prevent excessive overloading or wear of steerage linkage. The pressure is automatically relieved once those end positions are reached.

DISCLOSURE OF INVENTION

In accordance with the present invention, a collapsible plunger includes a load carrying cylinder forming in inwardly facing tapered end, a plug matching the tapered end of the cylinder, forming an outwardly facing taper mating the inwardly facing tapered end of the cylinder and some means for tensioning to hold the plug in the end of the cylinder. The tapered end of the cylinder will yield to the plug at a predetermined force. In one arrangement, the tensioning means includes a stud bolt extending through the cylinder and having one end threadingly engaging the plug. A plunger clamp end abuts the end of the cylinder opposite the plug, and the stud bolt extends slidingly through the plunger clamp end. A nut threadingly engages the end of the stud bolt opposite the plug and is secured against the plunger clamp end. The nut is free to move away from the plunger clamp end so that the stud bolt is never in compression.

A preferred angle formed between the tapered end and the outer surface of the cylinder is approximately 30 degrees and a preferred range is between 5 degrees and 45 degrees. An O-ring seal sealingly engages the mating surfaces of the cylinder in the plug.

A preferred range of the predetermined force is between approximately 75,000 pounds and approximately 400,000 pounds. A particularly preferred range is between approximately 175,000 pounds and approximately 320,000 pounds.

The abutment surfaces of the cylinder and the plunger clamp end are preferably flat and permit some relative movement between the two. The alignment of the cylinder is thus not completely determined by the orientation of the plunger clamp end.

A wear resistant smooth surface coating is affixed to the outer surface of the cylinder for smoother operation.

These and other objects, advantages and features of this invention will be apparent from the following description taken with reference to the accompanying drawing, wherein is shown the preferred embodiments of the invention.

BEST MODE FOR CARRYING OUT THE INVENTION

Figure 1:
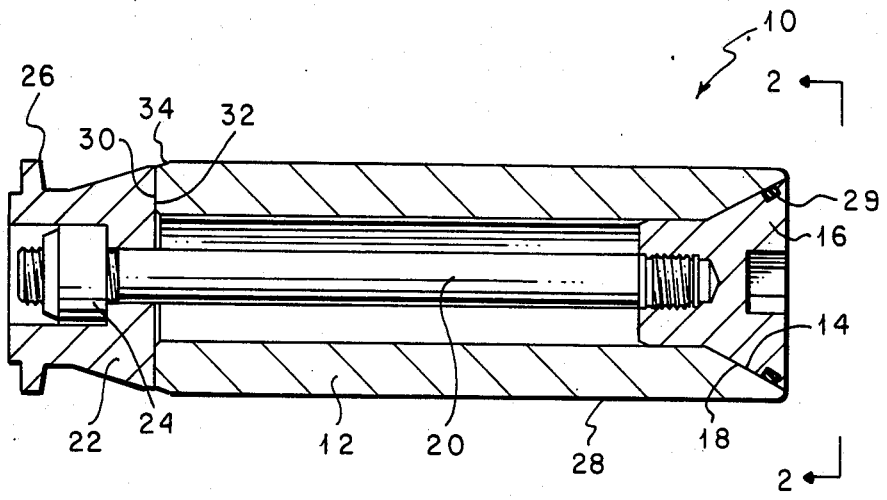
FIG. 1 is a longitudinal sectional view through a plunger according to the present invention.
Figure 2:
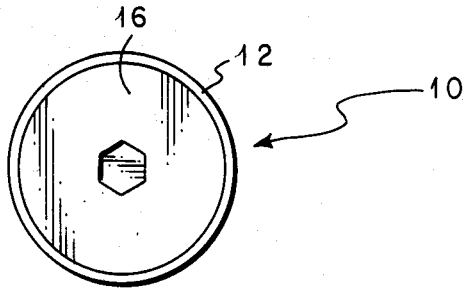
FIG. 2 is a right end view of the plunger shown in FIG. 1.

Referring now to the drawing, a collapsible plunger according to present invention is referred to generally by reference numeral 10. Collapsible plunger 10 includes a load carrying cylinder 12 forming an inwardly facing tapered end 14. A plug 16 matching tapered end 14 forms an outwardly facing taper 18 mating inwardly facing tapered end 14. A tensioning means including a stud bolt 20 extending through cylinder 12, a plunger clamp end 22 abutting the end of cylinder 12 opposite plug 16 and a nut 24 threadingly engaging the end of stud bolt 20 opposite the plug, holds plug 16 in the end of cylinder 12. Stud bolt 20 extends slidingly through plunger clamp end 22, and nut 24 is secured against the plunger clamp end. The nut is thus free to move away from the plunger claim end so that stud bolt 20 is never in compression.

Tapered end 14 of cylinder 12 will yield to plug 16 at a predeterminded force. In an application such as a sand fracturing unit where sand builds up and hardens in the pump, the tapered end of the cylinder is calculated to yield to the plug at a force which is less than that which would cause breakage in some other, more expensive part of the pump. Typically, some gripping means grips ears 26 of plunger end clamp 22 so that the power is transferred to collapsible plunger 10 by a pony rod. In a common pump unit for sand fracturing, the pony rod will break at slightly over 370,000 pounds of force so that a preferred range of the predetermined force is between approximately 175,000 and 320,000 pounds. In some units the force needed to break the pony rod is somewhat higher and a preferred range of the predetermined force is between approximately 75,000 pounds and approximately 400,000 pounds. One of the determinates of the amount of force needed to cause tapered end 14 to yield is the angle between taper 14 and outer surface 28 of the cylinder. A preferred angle is approximately 30 degrees and preferably between 5 degrees and 45 degrees.

Collapsible plunger 10 also includes an O-ring seal 29 which sealingly engages mating surfaces 14 and 18 of the cylinder and the plug respectively. Collapsible plunger 10 also includes a wear resistant smooth surface coating affixed to outer surface 28.

Abutment surfaces 30 and 32 of cylinder 12 and plunger clamp end 22 respectively are flat rather than piloted to permit some relative movement between the cylinder and the plunger clamp end. In this way, the alignment of cylinder 12 is not completely determined by the orientation of plunger clamp end 22. In this way, rings and packing in the pump can be used to align cylinder 12, thus decreasing wear on the packing. Cylinder 12 also includes an outwardly facing tapered end 34 to prevent catching cylinder 12 on the packing when installing the plunger by shoving it back through the packing.

It can thus be seen that in using a collapsible plunger according to the present invention, as a sand-out begins to build, and the stroke of the plunger is reduced, pressure is exerted back against plug 16 so that tapered end 14 of cylinder 12 begins to yield. At some point, cylinder 12 collapses by splitting and flaring open the end of the cylinder adjacent to the plug. Stud bolt 20 is then no longer in tension so that nut 24 can slide freely back in the recess of plunger clamp end 22. As the plunger is withdrawn on the backstroke, however, the flared end of cylinder 12 will catch on the rings of the packing which are normally of brass. The brass rings thus push back against the cylinder, once again tensioning stud bolt 20, but in this case breaking the stud bolt. The pump will continue its pumping action uninterrupted although the cylinder will no longer be operational. In this fashion, multiple cylinder pumps can continue to operate even when one of the cylinders has collapsed. The plunger is easily accessible so that it is easy to remove and replace.

During normal operation, a collapsible cylinder according to the present invention is only in tension and never in compression so that it is only in half of a stress cycle and should not fail in fatigue. A preferred form of a collapsible plunger according to the present invention can also withstand instantaneous force greater than the yielding force in order to not yield or collapse as a result of instantaneous operational pressures not the result of sand-out or other serious blockage. Such a plunger is also easier and less expensive to manufacture than previous plungers. The replacement cost of the plunger tube is reduced. The total number of components required to produce several different plunger sizes is also reduced because several different plunger sizes can use the same tapered plug, stud bolt and plunger clamp end. This reduces the required inventory and also increases the manufacturing quantities which should also reduce the total cost to produce all the different plunger sizes.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawing is to be interpreted as illustrative and not in a limiting sense.

We claim:

1. A collapsible plunger for use in a pump comprising in combination;

a load carrying cylinder forming an inwardly facing tapered end:

a plug matching the tapered end of the cylinder, forming an outwardly facing taper mating the inwardly facing tapered end of the cylinder; and tensioning means holding the plug in the end of the cylinder, wherein the tapered end of the cylinder will yield by flaring outwardly adjacent to the plug when a predetermined force is applied to the plug.

2. A collapsible plunger according to claim 1 wherein the tensioning means comprises in combination:

a stud bolt extending through the cylinder and having one end threadingly engaging the plug;

a plunger clamp end abutting the end of the cylinder opposite the plug, wherein the stud bolt extends slidingly through the plunger clamp end; and a nut threadingly engaging the end of the stud bolt opposite the plug, secured against the plunger clamp end wherein the nut is free to move away from the plunger clamp end so that the stud bolt is never in compression.

3. A collapsible plunger according to claim 2 wherein the angle formed between the tapered end and the outer surface of the cylinder is between approximately 5° and approximately 45°.

4. A collapsible plunger according to claim 2 further comprising an O-ring seal sealingly engaging the mating surfaces of the cylinder and the plug.

5. A collapsible plunger according to claim 2 wherein the predetermined force is between approximately 75,000 pounds and approximately 400,000 pounds.

6. A collapsible plunger according to claim 2 wherein the predetermined force is between approximatley 175,000 pounds and approximately 320,000 pounds.

7. A collapsible plunger according to claim 2 wherein the abutment surfaces of the cylinder and the plunger clamp end permit some relative movement between the cylinder and the plunger clamp end in normal operation and the alignment of the cylinder is not completely determined by the orientation of the plunger clamp end during such normal operation.

8. A collapsible plunger according to claim 2 further comprising a wear resistant smooth surface coating affixed to the outer surface of the cylinder.

9. A collapsible plunger according to claim 1 further comprising a wear resistant smooth surface coating affixed to the outer surface of the cylinder.

10. A collapsible plunger according to claim 1 wherein the predetermined force is between approximately 75,000 pounds and approximately 400,000.

11. A collapsible plunger according to claim 1 wherein the predetermined force is between approximately 175,000 pounds and approximately 320,000 pounds.

* * * * *